US007527041B2

(12) United States Patent
Wing et al.

(10) Patent No.: US 7,527,041 B2
(45) Date of Patent: May 5, 2009

(54) FUEL INJECTION VALVE

(75) Inventors: Richard Wing, Vancouver (CA); Ian Lockley, Ann Arbor, MI (US); Kevin Oversby, Vancouver (CA)

(73) Assignee: Westport Power Inc., Vancouver, BC (CA)

( * ) Notice: Subject to any disclaimer, the term of this patent is extended or adjusted under 35 U.S.C. 154(b) by 28 days.

(21) Appl. No.: 11/621,324

(22) Filed: Jan. 9, 2007

(65) Prior Publication Data

US 2008/0041344 A1 Feb. 21, 2008

Related U.S. Application Data

(63) Continuation of application No. PCT/CA2005/001062, filed on Jan. 8, 2005.

(51) Int. Cl.
*F02M 37/04* (2006.01)
*F02M 51/00* (2006.01)

(52) U.S. Cl. ..... 123/498; 123/478; 123/496

(58) Field of Classification Search ..... 123/478, 123/496, 498; 239/585.1, 102.2
See application file for complete search history.

(56) References Cited

U.S. PATENT DOCUMENTS

| | | | | |
|---|---|---|---|---|
| 4,501,245 | A | 2/1985 | Taira | |
| 4,546,739 | A | 10/1985 | Nakajima et al. | |
| 5,697,554 | A | 12/1997 | Auwaerter et al. | |
| 6,298,829 | B1 | 10/2001 | Welch et al. | |
| 6,363,913 | B1 * | 4/2002 | Milam et al. | 123/446 |
| 6,564,777 | B2 | 5/2003 | Rahardja et al. | |
| 6,568,602 | B1 * | 5/2003 | Bram et al. | 239/5 |
| 6,575,138 | B2 | 6/2003 | Welch et al. | |
| 6,584,958 | B2 | 7/2003 | Rahardja et al. | |
| 6,637,675 | B2 * | 10/2003 | Carroll et al. | 239/533.4 |
| 6,705,543 | B2 * | 3/2004 | Carroll et al. | 239/96 |
| 6,971,172 | B2 * | 12/2005 | Crofts | 29/890.125 |
| 7,100,577 | B2 * | 9/2006 | Mumford et al. | 123/498 |
| 7,140,353 | B1 * | 11/2006 | Rauznitz et al. | 123/446 |
| 7,334,741 | B2 * | 2/2008 | Benson et al. | 239/5 |
| 2005/0274360 | A1 * | 12/2005 | Mumford et al. | 123/446 |

FOREIGN PATENT DOCUMENTS

| | | | |
|---|---|---|---|
| CN | 1133941 | A | 10/1996 |
| EP | 0615065 | A1 | 9/1994 |
| EP | 0615065 | B1 | 11/1998 |
| EP | 0994248 | A3 | 5/2000 |
| JP | 61-190165 | | 8/1986 |
| WO | WO 85/02445 | | 6/1985 |

* cited by examiner

*Primary Examiner*—Thomas N Moulis
(74) *Attorney, Agent, or Firm*—McAndrews, Held & Malloy, Ltd.

(57) ABSTRACT

A fuel injection valve introduces a fuel into an engine and controlling fuel flow to reduce variability between injection events. The fuel injection valve employs an arrangement for a valve nozzle that cooperates with a valve needle to provide a range of needle movement within which the fuel mass flow rate is substantially constant. This can be achieved by providing a restriction with a constant flow area for a predetermined range of needle movement. The method comprises commanding a valve needle to a position within the predetermined range of needle movement to reduce variability in the fuel mass flow rate, particularly when the engine is idling or operating under low load conditions. Valve needle lift is variable during an injection event and from one injection event to another injection event.

17 Claims, 8 Drawing Sheets

FUEL INJECTION VALVE

CROSS-REFERENCE TO RELATED APPLICATION(S)

This application is a continuation of International Application No. PCT/CA2005/001062, having an international filing date of Jan. 8, 2005, entitled "Fuel Injection Valve". International Application No. PCT/CA2005/001062 claimed priority benefits, in turn, from Canadian Patent Application No. 2,473,639 filed Jul. 9, 2004. International Application No. PCT/CA2005/001062 is hereby incorporated by reference herein in its entirety.

FIELD OF THE INVENTION

The present invention relates to a fuel injection valve and a method of operating such a fuel injection valve for controlling fuel flow into an internal combustion engine. More particularly, the fuel injection valve comprises a nozzle arrangement that provides a substantially constant flow rate for a predetermined range of valve needle movement.

BACKGROUND OF THE INVENTION

A fuel injection valve can employ a number of control strategies for governing the quantity of fuel that is introduced into the combustion chamber of an internal combustion engine. For example, some of the parameters that can be manipulated by commonly known control strategies are the pulse width of the injection event, fuel pressure, and the valve needle lift.

The "pulse width" of an injection event is defined herein by the time that a fuel injection valve is open to allow fuel to be injected into the combustion chamber. Assuming a constant fuel pressure and a constant valve needle lift, a longer pulse width generally results in a larger quantity of fuel being introduced into the combustion chamber.

However, fuel pressure need not be constant from one injection event to another and fuel pressure can be raised to increase the quantity of fuel that is introduced into the combustion chamber. Conversely fuel pressure can be reduced to inject a smaller quantity of fuel into the engine, for example during idle or low load conditions.

As yet another example, some types of fuel injection valves can control valve needle lift to influence the quantity of fuel that is introduced into a combustion chamber. An increase in needle lift generally corresponds to an increase in the quantity of fuel that is injected and some fuel injection valves can be controlled to hold the valve needle at an intermediate position between the closed and fully open positions to allow a flow rate that is less than a maximum flow rate. To control valve needle lift a fuel injection valve can employ mechanical devices or an actuator that is controllable to lift and hold the needle at intermediate positions between the closed and fully open positions.

European Patent Specification No. EP 0615065 B1 ("Shibata") discloses a fuel injection valve for injecting a liquid fuel using an injection pump with a cam driven plunger that reciprocates to increase fuel pressure to actuate the fuel injection valve. The cam has a low-speed area where the fuel supply rate of the pump is low and a high-speed area where the fuel-supply rate is high so that the plunger is movable at a variable speed. The injection valve has an elongated pin formed on the nozzle needle for keeping the size of the fuel passage at the injection port substantially constant when the pin is positioned in the injection hole even when the nozzle needle moves, whereby the fuel injection mass flow rate is substantially constant until the pin is lifted out of the injection hole. Shibata discloses an apparatus and method that can be employed to shape the fuel injection mass flow rate during the course of an injection event whereby the fuel injection rate is initially low (while the pin is positioned in the injection hole), and then raised to a higher fuel injection rate (when the pin is lifted from the injection hole). However, because the injection pump is mechanically operated using a cam and plunger arrangement, the shape of the fuel injection mass flow rate is generally the same for each injection event. For each injection event the nozzle needle is continuously moving from the closed position to the fully open position and then back to the closed position, with the pin at the end of the nozzle needle providing a restriction that produces the step shaped injection pulse. Shibata does not disclose an apparatus or method for regulating fuel mass flow by actuating a valve needle that is operable to hold the valve needle at intermediate positions and a method whereby the valve needle lift is variable both during an injection event and from one injection event to another injection event. That is, Shibata does not disclose an apparatus or method that allows partial valve needle lift to an intermediate position for the duration of an injection event so that the lower mass flow rate is provided for the entire injection event, and that also allows valve lift to a fully open position for another injection event.

A difficult task for known control strategies is controlling the quantity of fuel that is injected into an engine's combustion chamber under idle or low load conditions. Under such conditions the fuel injection valve is required to inject only a small amount of fuel into the combustion chamber, and even small variations in the quantity of fuel that is injected into the combustion chamber can result in a significant variance in the injected quantity of fuel that can cause unstable operation. Under high load conditions, variations in the quantity of fuel of the same order of magnitude have less impact on engine operation because they represent a much smaller variation in the difference between the desired quantity of injected fuel versus the actual quantity of injected fuel, when this difference is considered as a percentage of the total quantity of injected fuel.

To control the quantity of fuel injected during idle and low load conditions, if the control strategy manipulates only pulse width, this strategy can result in a pulse width that is too short to provide consistent and efficient combustion. Accordingly, simply shortening pulse width at idle or low load conditions to reduce the quantity of injected fuel is not a desirable strategy.

A pulse width sufficiently long for idle or low load conditions can be achieved by reducing the fuel pressure. For liquid fuels this is a viable strategy, but it requires a system for controlling fuel pressure, adding to the cost and complexity of the fuel injection system. For example, known liquid fuel systems can reduce fuel pressure by returning a portion of the high-pressure fuel to the fuel tank. With liquid fuels, there are limitations on how low the pressure can be reduced since a minimum fuel pressure is required to atomize the fuel when it is introduced into the engine's combustion chamber. However, this approach is more difficult with a gaseous fuel. Since a gas is a compressible fluid, compared to a liquid fuel, much more gaseous fuel must be returned to the fuel tank for a comparable reduction in fuel pressure, and if the gaseous fuel tank is pressurized, there can be times when the tank pressure exceeds the fuel rail pressure, making return flow impossible. Consequently, it can be difficult to rapidly reduce the pressure of a gaseous fuel without venting some of the fuel to atmosphere, which is undesirable. Accordingly, it can be difficult to control fuel pressure to achieve the desired responsiveness for controlling the fuel injection mass flow rate during an injection event or from one injection event to the next. It can also be difficult to control fuel pressure and injection valve operation to accurately inject the exact quantity of fuel with the precision desired for each injection event, and again, only small variations in fuel quantity can cause unstable operating conditions. Therefore, controlling fuel injection pressure alone is not a desirable strategy for regulating fuel mass flow rate through a fuel injection valve.

If a fuel injection valve is operable to control valve needle lift, flow rate can be controlled to provide a sufficiently long pulse width to inject the desired quantity of fuel for an engine that is idling or operating under low load conditions. As shown in Japanese Patent Application No. 60-031204 (Japanese Patent Publication No. 61-190165), a fuel injection valve can be provided with a stopper that is movable to limit the lift of the valve needle. This type of mechanical arrangement adds considerable complexity to the fuel injection valve and, consequently, higher manufacturing costs, space requirements for installing the injection valve assembly, maintenance costs, and reliability concerns.

In another approach, fuel injection valves are known that control the quantity of injected fuel by employing variable orifice areas. That is, the injection valve can have two sets of orifices whereby the valve is operable to inject fuel through only one set of orifices when a smaller quantity of fuel is to be injected, and fuel is injected through both sets of orifices when a larger quantity of fuel is to be injected. U.S. Pat. No. 4,546,739 discloses an example of such an injection valve. Like other known mechanical solutions this arrangement adds complexity and the associated disadvantages of higher manufacturing costs, maintenance costs, and concerns for reliability.

Another type of fuel injection valve can be directly actuated by a strain-type actuator, which can be commanded to lift the valve needle to any position between its closed and open position. Co-owned U.S. Pat. Nos. 6,298,829, 6,564,777, 6,575,138 and 6,584,958, which are hereby incorporated by reference in their entirety, disclose examples of directly actuated fuel injection valves that employ a strain-type actuator. For example, if the strain-type actuator is a piezoelectric actuator, by controlling the charge applied to the actuator the valve needle lift can be commanded to the desired lift position. However, even with this approach there can be variability of fuel flow from one injection event to the next because the actual valve needle lift may not always accurately match the commanded lift. Variability in the actual valve needle lift can be caused by a number of factors, including, for example, one or more of variations in combustion chamber pressure, variations in fuel pressure, the effects of differential thermal expansion/contraction within the fuel injection valve, and component wear within the fuel injection valve. Accordingly, even with a fuel injection valve that employs an actuator that allows lift control, there can be factors that cause variability in the actual lift that can still be large enough to cause variability in the quantity of injected fuel.

Engine instability at idle and low load conditions can cause higher engine fuel consumption, exhaust emissions, noise and vibration. Accordingly, there is a need for an apparatus and method that provides a more consistent means of controlling the quantity of fuel injected during each injection event when an engine is idling or under low load conditions and that improves combustion stability under such conditions.

For compression ignition engines that burn a gaseous fuel it can be beneficial to shape the rate of fuel injection to begin an injection event with an initial low mass flow rate, followed by a higher mass flow rate until the end of the fuel injection event. An example of this is disclosed in co-owned and co-pending U.S. patent application Ser. No. 10/414,850, entitled, "Internal Combustion Engine With Injection Of Gaseous Fuel", which is hereby incorporated by reference in its entirety. It can be difficult to operate a conventional fuel injection valve to provide the stepped flow characteristic that is needed to achieve this result. If a fuel injection valve that provides a substantially constant mass flow rate for a predetermined range of valve needle movement can be made so that this constant mass flow rate corresponds to the initial low mass flow rate for a stepped injection event, such a feature can be useful for improving injection consistency and engine performance for all operating conditions from idle through to full load.

SUMMARY OF THE INVENTION

A fuel injection valve introduces a fuel into an engine. The fuel injection valve comprises: a. a valve body that comprises a nozzle and that defines a fuel cavity disposed within the valve body; b. a valve needle movable within the nozzle between a closed position at which the valve needle is seated against a valve seat associated with the nozzle, and a fully open position at which the valve needle is spaced furthest apart from the valve seat to allow the fuel to flow from the fuel cavity and into the engine through the nozzle; and c. an actuator for actuating the valve needle that is operable to hold the valve needle at intermediate positions between the seated and fully open positions, whereby valve needle lift is variable during an injection event and from one injection event to another injection event. That is, the valve needle lift is variable in that, for example, the valve needle can be commanded to, and if desired, held at, different positions at different times during a single injection event. Valve needle lift is also variable from one injection event to another injection event in that the shape of a plot of valve needle lift against time can be different for different injection events, for example with a relatively low needle lift and a rectangular shape for engine idle conditions and a step shape for high load conditions with the second step being substantially larger than the first step.

When the valve needle is positioned between a first intermediate position proximate to the closed position and a second intermediate position spaced from the first intermediate position, the valve needle and the valve body are shaped to cooperatively provide a constant flow area between the valve needle and the valve body. The constant flow area restricts flow through the nozzle so that mass flow rate is substantially constant for a range of valve needle movement with boundaries of the range of movement defined by the first and second intermediate positions.

To reduce the variability in flow rate when the valve needle is positioned between the first and second intermediate positions, the constant flow area is preferably smaller than the open flow area between the valve seat so that the constant flow area controls the fuel mass flow rate through the fuel injection valve when the valve needle is positioned between the first and second intermediate positions.

The constant flow area can be provided by an annular gap between the valve needle and the valve body or by grooves formed in the valve body or the valve needle. The raised portions between the grooves can act as guides for the valve needle to add consistency to the positioning of the valve needle on the valve seat.

In preferred embodiments, the fuel injection valve further comprises a strain-type actuator for directly actuating the valve member. The strain-type actuator can comprise a transducer selected from the group consisting of piezoelectric, magnetostrictive, and electrostrictive transducers. An electronic controller can be programmed to send command signals to the actuator to move the valve needle between the closed position and the fully open position and to positions therebetween according to predetermined waveforms.

The fuel injection valve can further comprise an amplifier disposed between the actuator and the valve member to amplify the strain produced by the actuator to cause larger corresponding movements of the valve member. The amplifier can be a hydraulic displacement amplifier, or it can employ at least one lever to amplify the strain mechanically.

In preferred embodiments, the fuel is introducible into the fuel cavity in the gaseous phase. The fuel can be selected from the group consisting of natural gas, methane, ethane, liquefied petroleum gas, lighter flammable hydrocarbon derivatives, hydrogen, and blends thereof.

The valve needle can be an inward opening valve needle whereby the valve needle is movable in an inward direction opposite to the direction of fuel flow when moving from the closed position towards the open position. In this embodiment the nozzle can comprise a closed end with at least one orifice through which the fuel can be injected when the valve needle is spaced apart from the valve seat. In preferred embodiments, the nozzle comprises a plurality of orifices through which the fuel can be injected when the valve needle is spaced apart from the valve seat and the collective open area of the plurality of orifices is greater than the constant flow area. When the valve needle is in the fully open position, the collective open area of the plurality of orifices provides the smallest restriction for the fuel flowing through the nozzle and thereby governs the mass flow rate of fuel flowing through the fuel injection valve.

In another embodiment the fuel injection valve can further comprise a third intermediate position spaced from the second intermediate position, defining a boundary of a second range of valve needle movement between the second and third intermediate positions. When the valve needle is positioned between the second and third intermediate positions the valve body and the valve needle can be shaped to cooperatively provide a second constant flow area that restricts flow through the nozzle so that mass flow rate is substantially constant but higher than the mass flow rate when the valve needle is positioned between the first and second intermediate positions.

By way of example, preferred embodiments are illustrated and described of a fuel injection valve for injecting a fuel directly into a combustion chamber of an engine. Without departing from the spirit and scope of this disclosure, persons skilled in this technology will understand that other arrangements for the valve body and the valve needle of the fuel injection valve are also possible. The scope of the disclosed fuel injection valve includes nozzles and valve needles that are shaped to cooperate with each other so that, when the valve needle is positioned between a first intermediate position proximate to the closed position and a second intermediate position spaced from the first intermediate position, a substantially constant pressure drop occurs when the fuel is flowing through the nozzle so that mass flow rate is substantially constant for a range of valve needle movement with boundaries of the range of movement defined by the first and second intermediate positions.

A method regulates fuel mass flow rate into an engine through a nozzle of a fuel injection valve. The method comprises: actuating a valve needle to control valve needle lift, which is variable during an injection event and from one injection event to another injection event, responsive to measured engine operating conditions, comprising engine load and speed; commanding a valve needle to move to a position between first and second predetermined intermediate positions, which are between a closed position and a fully open position when a predetermined constant fuel mass flow rate is desired, wherein the fuel injection valve is designed to allow a substantially constant fuel mass flow rate when the valve needle is positioned between the first and second intermediate positions and the pressure of the fuel is constant; and commanding the valve needle to move to positions between the closed and fully open positions, but not between the first and second intermediate positions, when a fuel mass flow rate different from the predetermined constant fuel mass flow rate is desired.

Preferably the method further comprises commanding the valve needle to the mid-point, between the first and second intermediate positions when the substantially constant mass flow rate is desired. Because there can be some variability between the commanded needle position and the actual needle position, commanding the valve needle to the mid-point of the range of movement reduces the likelihood of the actual valve needle position being outside of the range of movement defined by the predetermined first and second intermediate positions. Overall, this reduces variability in the fuel mass flow rate delivered into the combustion chamber.

In preferred embodiments of the method, the substantially constant fuel mass flow rate corresponds to the desired fuel mass flow rate for idle or low load conditions. As indicated already, under these conditions an engine is most susceptible to variations in fuel mass flow rate because the required amount of fuel to be injected is already small, compared to when the engine is operating under higher loads, and even small variations in fuel mass flow rate can have an adverse effect on stable engine operation, with corresponding adverse impacts on engine performance characteristics such as engine emissions, noise, and/or efficiency.

In a preferred embodiment of the method, providing a flow restriction within the nozzle with a constant flow area when the valve needle is positioned between the first and second intermediate positions regulates the substantially constant fuel mass flow rate. When the second intermediate position corresponds to a larger valve needle lift than that of the first intermediate position, fuel mass flow rate can be substantially and progressively increased by moving the valve needle from the second intermediate position toward the fully open position.

The method can further comprise commanding the valve needle to a position between the second intermediate position and a third intermediate position when a second substantially constant mass flow rate is desired, where the second intermediate position corresponds to a larger valve needle lift than that of the first intermediate position and the third intermediate position corresponds to a larger needle lift than that of the second intermediate position. The fuel injection valve can be designed with flow restrictions such that the first restricted flow area is smaller than the second restricted flow area that is substantially constant when the valve needle is positioned between the second and third intermediate positions. In this embodiment of the method, the fuel mass flow rate can be substantially and progressively increased by moving the valve needle from the third intermediate position toward the fully open position. For example, the first constant mass flow rate can be selected when the engine is idling and the second constant mass flow rate can be selected when the engine is operating under predetermined low load conditions.

The method preferably comprises injecting the fuel from the nozzle directly into a combustion chamber of the engine.

By injecting the fuel directly into the combustion chamber, the engine can maintain the compression ratio and efficiency of an equivalent engine burning diesel fuel. If the fuel is injected into the air intake system upstream of the intake valve, to avoid early detonation of the fuel it may be necessary to limit the amount of fuel injected and/or to reduce the engine's compression ratio.

The present method is particularly suitable for fuel that is in the gaseous phase when it is flowing through the nozzle. Accordingly, the method can further comprise introducing the fuel into the nozzle in the gaseous phase. For example, the fuel can be selected from the group consisting of natural gas, methane, ethane, liquefied petroleum gas, lighter flammable hydrocarbon derivatives, hydrogen, and blends thereof.

A preferred embodiment of the method further comprises directly actuating the valve needle with a strain-type actuator that can be activated to cause corresponding movements of the valve needle. Strain-type actuators are particularly suited to implementing the disclosed method because they can be controlled to command the valve needle to move to and be held at any intermediate position between the closed and fully open positions. The strain-type actuator preferably comprises a transducer selected from the group consisting of piezoelectric, magnetostrictive, and electrostrictive transducers.

The method can further comprise also controlling injection pulse width to assist with controlling the amount of fuel that is injected during an injection event, whereby pulse width is variable from one injection event to another injection event responsive to predetermined measured engine operating conditions. Whereas controlling pulse width alone is not a desired strategy for regulating the mass quantity of fuel injected, pulse width control can be combined with the disclosed method to provide greater flexibility so that the desired mass quantity of fuel can be introduced into the combustion chamber as determined from the measured engine operating conditions and with reference to an engine map. For example, some of the engine operating conditions can include engine speed and engine load. Other operating conditions can also be monitored and an electronic control unit can be programmed to determine if any adjustments should be made to correct for other variables such as fuel temperature; intake air temperature, fuel injection pressure, and in-cylinder pressure.

Similarly, the method can further comprise controlling injection pressure to assist with controlling the amount of fuel that is injected during an injection event, whereby fuel injection pressure is variable from one injection event to another responsive to predetermined measured engine operating conditions.

A method of regulating fuel mass flow rate into an engine through a nozzle of a fuel injection valve by controlling valve needle position, the method comprising: increasing fuel mass flow rate from zero to a first value by moving the valve needle from a closed position where it is urged against a valve seat to a first intermediate position; maintaining fuel mass flow rate substantially constant at about the first value when the valve needle is positioned between the first intermediate position and a second intermediate position, which is spaced from the first intermediate position; progressively increasing fuel mass flow rate beyond the first value by moving the valve needle from the second intermediate position towards a folly open position; increasing fuel mass flow rate to a maximum value by moving the valve needle to the folly open position; and actuating the valve needle to control valve needle lift responsive to measured engine operating conditions, comprising engine speed and load, wherein the valve needle position is variable during an injection event and from one injection event to another injection event.

In a preferred method, the first value is the fuel mass flow rate that is commanded when the engine is operating under idle or low load conditions.

The preferred method can further comprise commanding the valve needle to move according to a stepped waveform with a relatively low mass flow rate during a first step and a higher mass flow rate during a second step and wherein the first value is the fuel mass flow rate that is commanded for the first step.

The method preferably comprises moving the valve needle by actuating a strain-type actuator that can be commanded to produce a linear displacement that is transmitted to the valve needle. With such an actuator, the plot of displacement over time can follow any commanded shape, and need not be the same shape for each injection event. For example, for idle conditions, a small displacement with a substantially rectangular shape can be commanded. For higher loads, a step-shape can be employed with a relatively low initial displacement followed by a higher actuator displacement.

BRIEF DESCRIPTION OF THE DRAWINGS

The drawings illustrate specific embodiments of the invention, but should not be considered as restricting the spirit or scope of the invention in any way.

FIG. 2A shows the valve needle in the closed position. FIG. 2B shows the valve needle positioned in a region that provides a constant flow area thereby producing a substantially constant flow rate for a range of needle movement. FIG. 2C shows the valve needle lifted beyond the region of constant, flow area. FIGS. 2A, 2B and 2C illustrate an embodiment of the features that can be employed to make the fuel injection valve operable to inject a substantially constant quantity of fuel for a predetermined range of valve needle movement.

FIGS. 2D shows a simple concentric circular arrangement that defines an annular constant flow area between the valve needle and the valve body. FIG. 2E provides an example of another embodiment where a constant flow area is provided by a plurality of grooves formed in the valve body.

FIG. 4A shows the valve needle in the closed position. FIG. 4B shows the valve needle positioned in a region that provides a constant flow area thereby producing a substantially constant flow rate for a range of needle movement. FIG. 4C shows the valve needle lifted beyond the region of constant flow area.

DETAILED DESCRIPTION OF PREFERRED EMBODIMENT(S)

The schematic views are not drawn to scale and certain features may be exaggerated to better illustrate their functionality.

Figure 1:
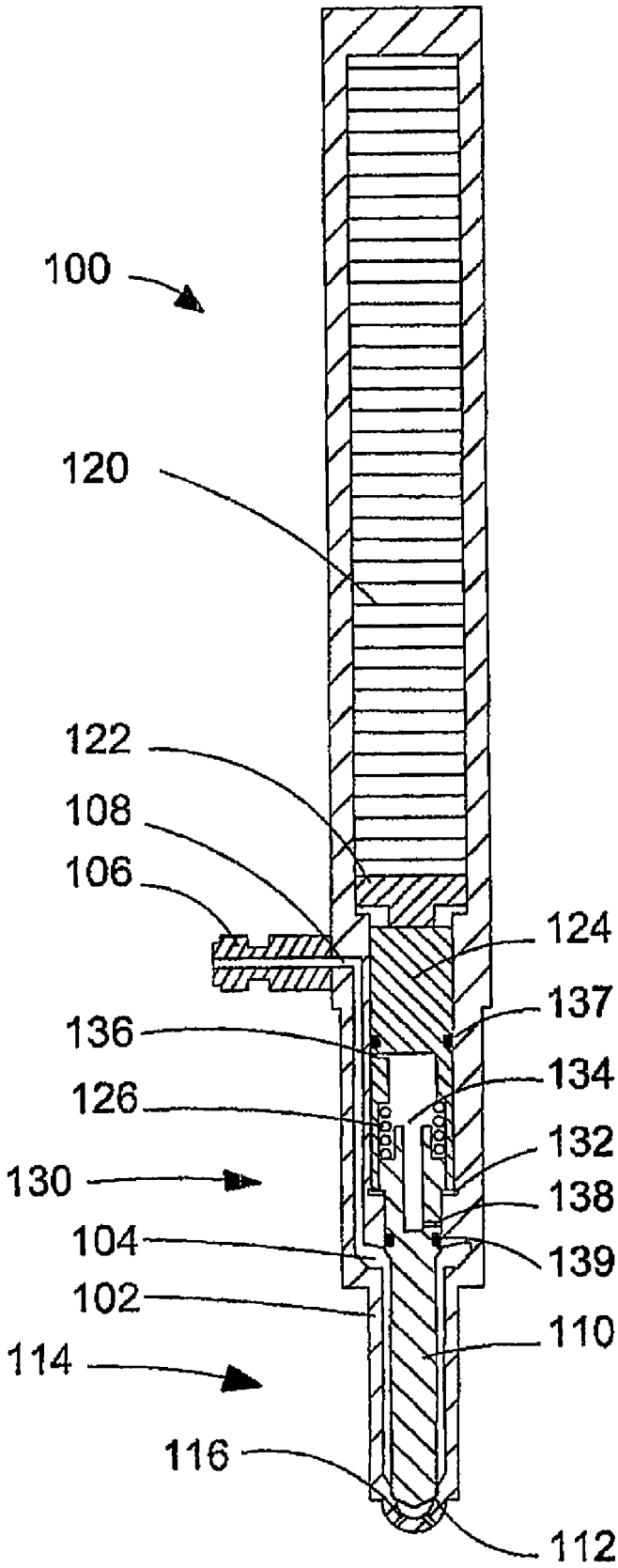
FIG. 1 is a schematic view of a directly actuated fuel injection valve that is operable to inject a substantially constant quantity of fuel for a predetermined range of valve needle movement.

FIG. 1 is a schematic cross-sectional view of fuel injection valve 100, which can be employed to introduce fuel into an engine. Valve body 102 houses valve needle 110, actuator 120, and transmission assembly 130. Valve body 102 also defines fuel cavity 104, which comprises fuel passages extending from coupling 106 and fuel inlet 108 through to valve seat 112. Valve needle 110 is movable within nozzle 114 between a closed position at which valve needle 110 is seated against valve seat 112 and a fully open position at which valve needle 110 is spaced furthest apart from valve seat 112. When valve needle 110 is spaced apart from valve seat 112, fuel can flow from fuel cavity 104 into the engine through nozzle 114. In the example illustrated by FIG. 1, fuel exits nozzle 114 through orifices 116. In the case of an outward opening valve needle (see for example FIGS. 4A, 4B, 4C and 5), fuel can exit the nozzle directly through the opening between the valve needle and the valve seat.

The disclosed features for influencing the flow characteristics through a fuel injection valve are independent from the type of actuator employed to cause valve needle movements. Any actuator that can be controlled to influence the speed of valve needle actuation and/or to control valve needle position between the closed and fully open positions can benefit from the disclosed arrangement. For example, an electromagnetically actuated fuel injection valve can employ the disclosed features because the rate of opening for an electromagnetic valve can be controlled to a certain degree by controlling the rate of force rise. That is, using an electromagnetic actuator, the speed of valve needle movement can be kept slow during the beginning of a fuel injection event, prolonging the time when the fuel is introduced at a constant relatively low fuel mass flow rate before the fuel mass flow rate increases during the later part of the fuel injection event.

In preferred embodiments, injection valve 100 comprises a strain-type actuator for directly actuating valve needle 110 and providing the advantage of facilitating control over valve needle movements. A directly actuated fuel injection valve is defined herein as one that employs an actuator that can be activated to produce a mechanical movement that directly corresponds to a movement of the valve needle. In such a directly actuated fuel injection valve, the mechanical movements originating from the actuator can be amplified by one or more mechanical levers or a hydraulic amplifier, but the movements of the actuator always correlate to corresponding movements of the valve needle. In the example illustrated by FIG. 1, transmission assembly 130 transmits movements from actuator 120 to valve needle 110. Transmission assembly 130 comprises a hydraulic displacement amplifier mechanism that amplifies the mechanical movements originating from actuator 120. In this example, actuation of valve needle 110 occurs as now described. Actuator 120 can be activated to produce mechanical movements in an axial direction to move base 108 and plunger 124 towards nozzle 114. Plunger 124 displaces hydraulic fluid within amplification chamber 132. In the short time interval of an injection event, the volume of hydraulic fluid within amplification chamber 132 remains substantially constant. Since the hydraulic fluid is substantially incompressible, to accommodate the fluid displaced by plunger 124, valve needle 110 moves in the opposite direction, away from valve seat 112, thus opening the valve 100 and initiating a fuel injection event. The amount of amplification is predetermined by the relative end areas of plunger 124 and the shoulder of valve needle 110, which are both disposed in amplification chamber 132. That is, the higher the ratio between plunger end area and valve needle shoulder area, the greater is the needle stroke amplification.

Actuator 120 can be commanded to change the amount of strain during an injection event to move valve needle 110 to a different open position, or to reduce the strain to zero to end an injection event.

Spring 126 biases valve needle 110 in the closed position and helps to ensure that no spatial gaps form between actuator 120, transmission assembly 130 and valve needle 110.

In the illustrated example, transmission assembly 130 further comprises hydraulic fluid reservoir 134. Compared to the time interval of a fuel injection event, there are much longer periods of time between injection events and when the engine is not running, when there is sufficient time to allow some fluid flow between reservoir 134 and amplification chamber 132 through the small gaps provided between the adjacent surfaces of plunger 124, valve needle 110, and valve body 102 and conduits 136 and 138. Such flow between reservoir 134 and amplification chamber 132 can compensate for leakage of hydraulic fluid and small dimensional changes between components that can be caused, for example, by differential temperature expansion/contraction and wear.

Seals 137 and 139 seal against leakage of the hydraulic fluid into fuel cavity 104, which is necessary when valve 100 is employed to inject a gaseous fuel. If the fuel is a liquid fuel and it is conveniently employed as the hydraulic fluid, seal 139 is not necessary.

Strain-type actuators are generally controllable to produce any amount of strain between zero and a maximum amount of strain that is producible by a given actuator. That is, a strain-type actuator can be commanded to move valve needle 110 to an intermediate position where it can be held for a desired length of time. A controller can be programmed to command the actuator to change the amount of strain so that valve needle 110 is moved from the intermediate position to another open position or the closed position. This allows the movements of valve needle 110 to be commanded to follow a predetermined waveform, which provides more flexibility to control the fuel mass flow rate during an injection event, and this flexibility can be employed to improve combustion characteristics to increase performance or efficiency, and/or reduce the exhausted emissions of undesirable combustion products such as particulate matter or oxides of nitrogen or carbon, and/or reduce engine noise.

By way of example, actuator 120 is depicted schematically in FIG. 1 as a stack of piezoelectric elements for providing strain-type actuation of valve needle 110. Persons skilled in this technology will understand that other strain-type actuators, such as electrostrictive or magnetostrictive actuators, can be employed to achieve the same results.

While strain-type actuators can be commanded to produce a desired strain, there are variable effects such as temperature, wear, fuel pressure, intake manifold pressure and combustion chamber pressure, that can influence valve needle position differently from one injection event to another. Accordingly, even if an actuator is commanded to produce a given strain that normally corresponds to a desired valve needle position, the actual valve needle position may be different, and variances between actual position and the desired position can be significant enough to reduce combustion efficiency, especially when the engine is at idle or under low load conditions.

The features illustrated in FIGS. 2A, 2B, 2C, 2D, 2E, 3, 4A, 4B, 4C and 5 show embodiments of valve needles and valve bodies that are shaped to cooperatively provide a constant flow area between the valve needle and the valve body when the valve needle is positioned within a range of movement when the cooperating surfaces are held opposite to each other. This constant flow area restricts flow through the nozzle so that fuel mass flow rate is substantially constant. By commanding the valve needle to a position near the mid-point of this range, fuel mass flow rate is made substantially insensitive to small variations in needle position. All of the illustrated embodiments operate on the same principles and each can be advantageously employed to reduce variability between the commanded fuel mass flow rate and the actual fuel mass flow rate for idle and low load conditions, as well as higher load conditions when a stepped injection profile is commanded.

Figure 2A:
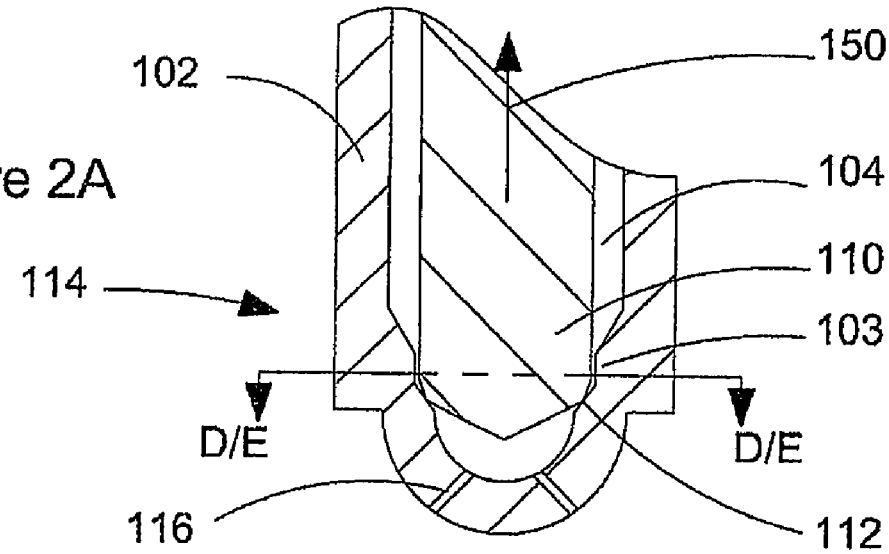
FIGS. 2A, 2B and 2C show schematic cross section views of a valve nozzle and valve needle tip that could be employed, for example, by the fuel injection valve of FIG. 1.
Figure 2B:
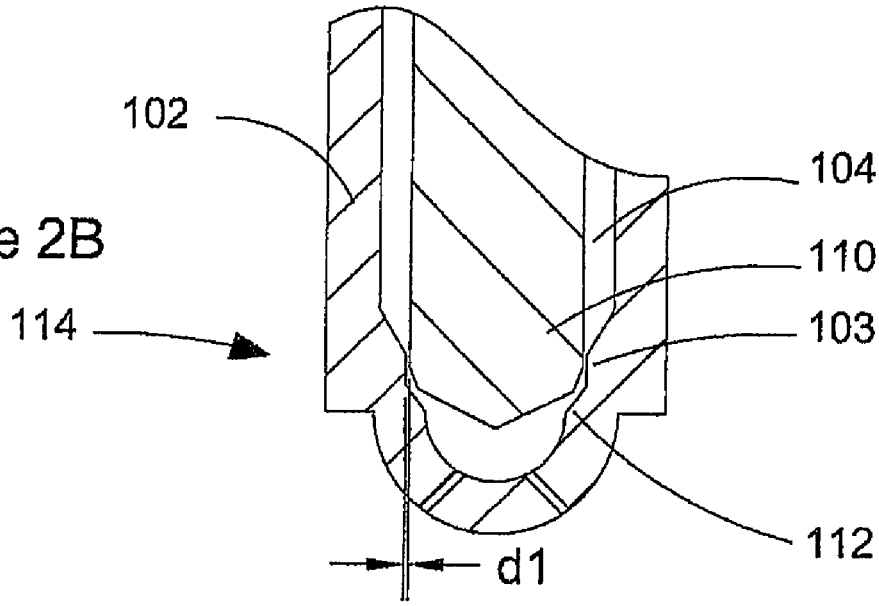
Figure 2C:
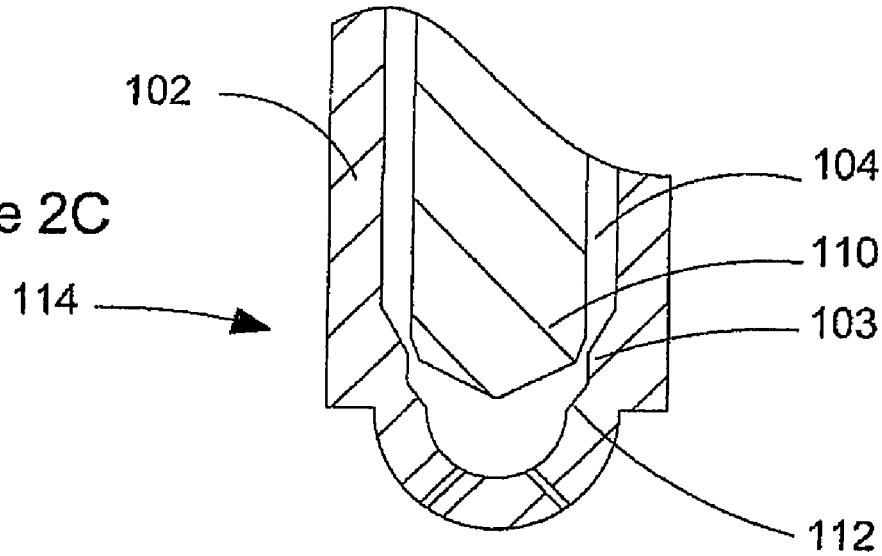

With reference now to the illustrated embodiment of FIGS. 2A, 2B and 2C, a valve needle and nozzle arrangement is schematically shown. This arrangement can be employed, for example, with the fuel injection valve of FIG. 1. Accordingly, the same reference numbers used in FIG. 1 are used to designate similar features in FIGS. 2A, 2B and 2C. Only the tip portion of nozzle 114 is shown, with valve body 102 defining a portion of fuel cavity 104 that surrounds valve needle 110. FIGS. 2A, 2B and 2C each depict the same embodiment, but with each figure showing valve needle 110 in a different position.

In FIG. 2A, valve needle 110 is shown in the closed position, seated against valve seat 112 so that fuel can not flow through orifices 116. To begin a fuel injection event, valve needle 110 is movable in the direction of arrow 150. Valve needles such as the one shown in FIGS. 1, 2A, 2B, 2C and 3 are movable away from a valve seat and in a direction opposite to the direction of fuel flow are known as inward opening valve needles. In FIG. 2B valve needle 110 has been lifted away from valve seat 112 to an open position. In FIG. 2B a portion of the vertical side surface of valve needle 110 is opposite to the vertical wall of valve body 102 provided by shoulder 103. The parallel and opposite vertical surfaces provide a flow restricting gap therebetween, identified by d1. This gap is sized to provide a flow area that restricts fuel flow through nozzle 114 to a substantially constant fuel mass flow rate for a range of valve needle movement as long as a portion of the vertical side surface of valve needle 110 is opposite to the vertical wall provided by shoulder 103. That is, because the cooperating vertical surfaces that form the gap are parallel to one another, the size of the gap remains constant for a range of valve needle movement. In FIG. 2C valve needle 110 has been lifted beyond the point where the vertical surfaces of valve needle 110 and shoulder 103 are opposite to each other. Beyond that point, the flow area between valve needle 110 and valve body 102 increases as valve needle 110 moves further away from valve seat 112. Valve needle 110 can be lifted further from the position in FIG. 2C until it reaches a folly open position. With a nozzle arrangement such as the one shown in FIG. 2C, a maximum fuel mass flow rate can be limited by the restriction of the open area provided by orifices 116. If such is the case, lifting the needle beyond the point where fuel flow becomes choked by the orifices does not result in further increases in the fuel mass flow rate.

Figure 2D:
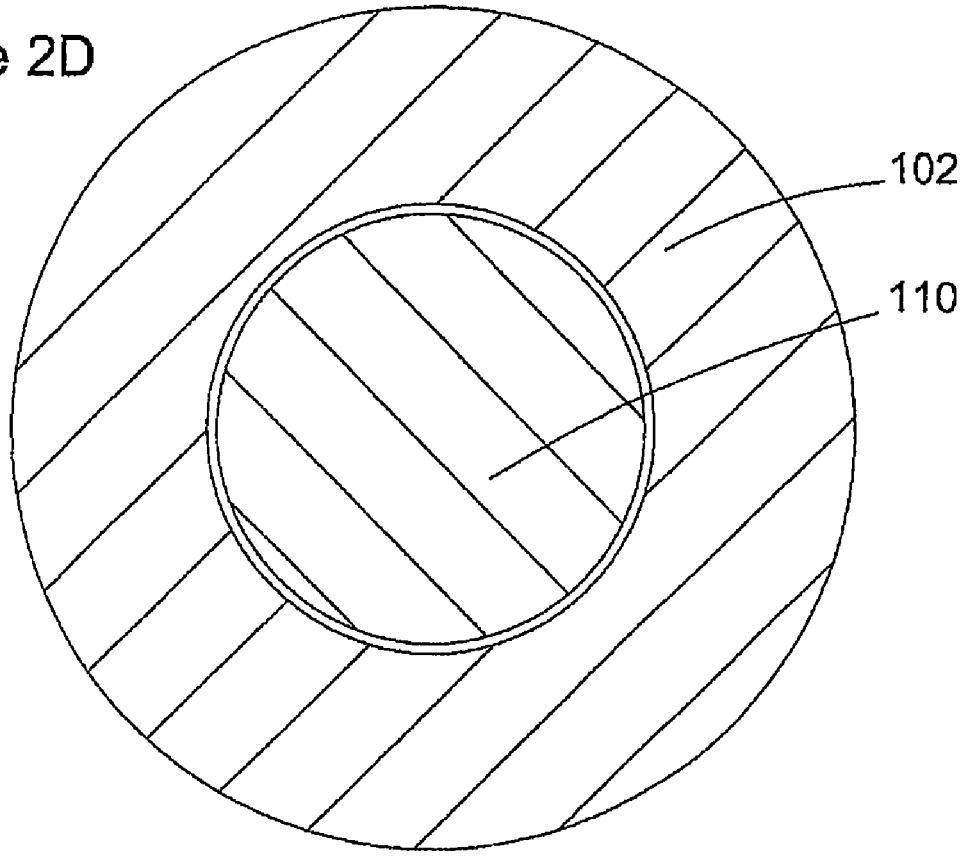
FIGS. 2D and 2E show section views through the section line marked D/E in FIG. 2A.
Figure 2E:
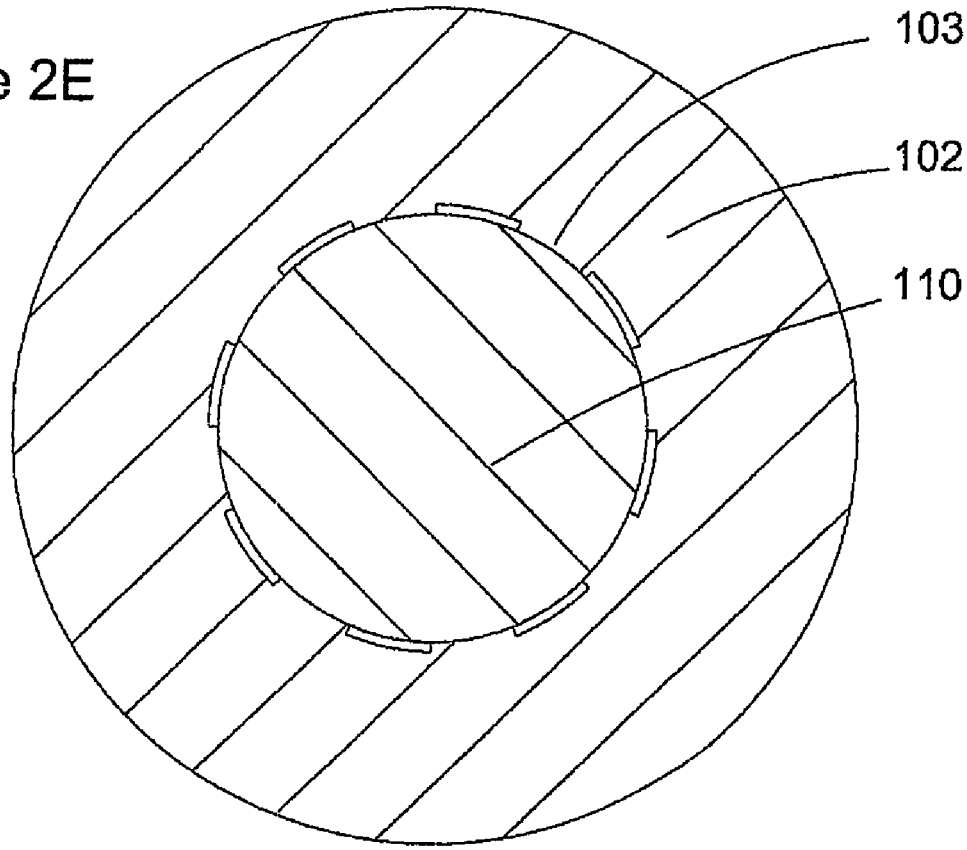

Reference is now made to FIGS. 2D and 2E, which show two different embodiments of a section view through the section line marked D/E in FIG. 2A. FIGS. 2D and 2E show that the constant flow area can be made in different shapes without departing from the spirit of the present disclosure. FIG. 2D shows a simple concentric circular arrangement that defines the constant flow area between valve needle 110 and the valve body 201. In FIG. 2E the constant flow area is provided by a plurality of grooves formed in the valve body 102. By way of example, the grooves are shown with a bottom defined by a diameter concentric with the opposite walls of valve needle 110, and shoulder 103 provides raised surfaces between the grooves. Persons skilled in this technology will understand that the grooves and raised surfaces between the grooves can take different shapes without departing from the scope of the present disclosure. While FIGS. 2D and 2E are introduced with reference to the embodiment of FIG. 2A, these examples of the shape for the constant flow area are applicable to all of the embodiments disclosed herein. With some embodiments, the grooves can be formed in the valve needle surface instead of the valve body surface.

Figure 3:
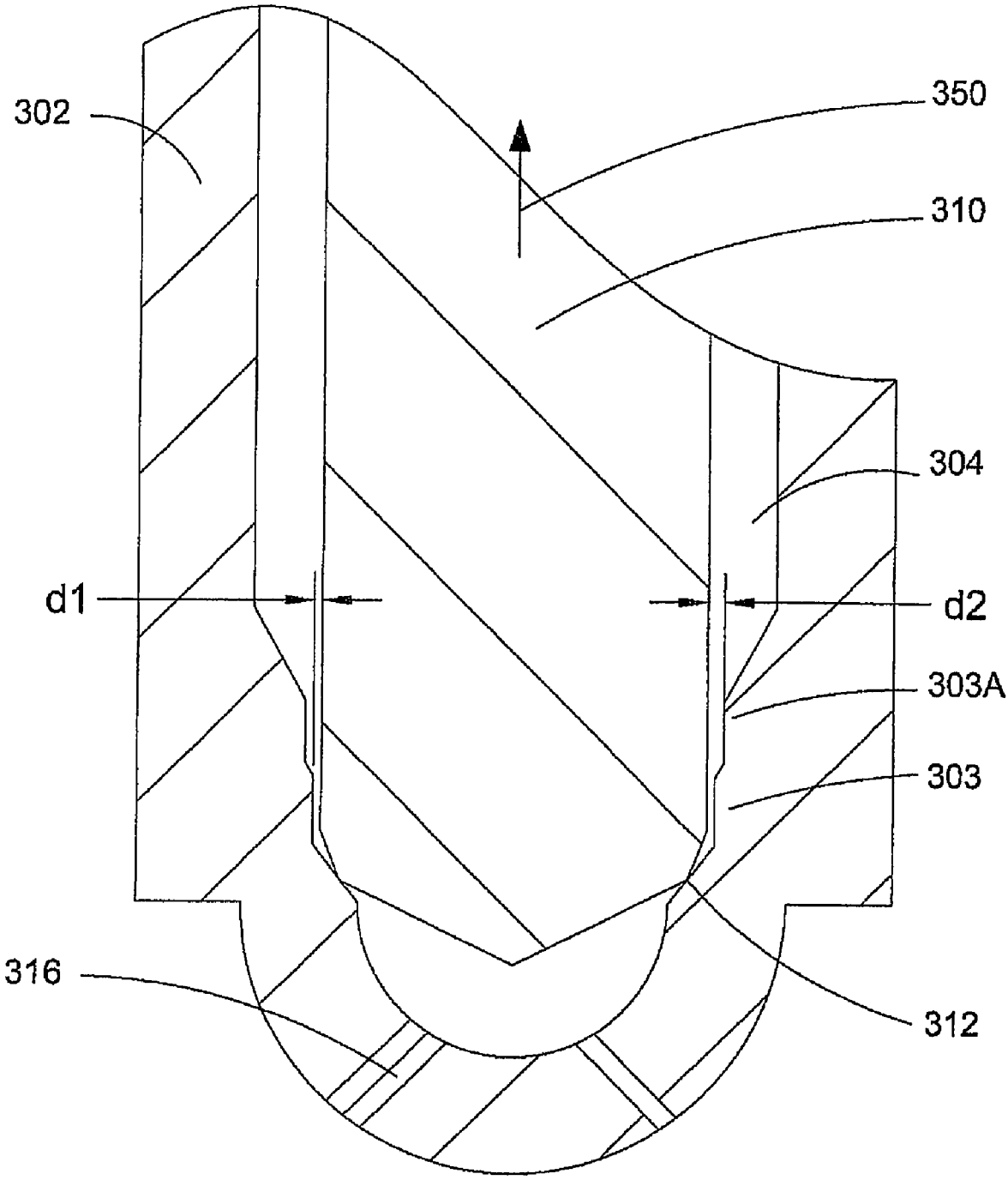
FIG. 3 is a schematic cross section view of a nozzle that comprises features for providing two different ranges of movement for an inward opening valve needle, with each range of movement providing a respective substantially constant flow rate determined by the constant flow area provided within each range.

Another embodiment of a nozzle with an inward opening valve needle is shown in FIG. 3. Valve body 302 and valve needle 310 define the shown portion of fuel cavity 304. Valve needle 310 is in the closed position, where it is urged into fluidly sealed contact with valve seat 312. Orifices 316 provide an outlet for the fuel to exit the valve body when valve needle 310 is lifted away from valve seat 312 in the direction of arrow 350. The difference between this embodiment and the embodiment of FIGS. 2A, 2B and 2C is that valve body 302 is provided with two shoulder areas 303 and 303A, which each provide a vertical surface parallel to the vertical surface of valve needle 310. Shoulder 303 in FIG. 3 is similar to shoulder 103 in FIGS. 2A, 2B and 2C. Shoulder 303A provides a second parallel surface area that provides a larger constant flow area when the vertical surface of valve needle 310 is opposite to it. Accordingly, the nozzle arrangement of FIG. 3 can provide two ranges of needle movement where the fuel mass flow rate can be substantially constant. A lower substantially constant fuel mass flow rate is provided when the vertical surface of valve needle 310 is opposite to the vertical surface of shoulder 303 and a higher substantially constant fuel mass flow rate is provided when the vertical surface of valve needle 310 is opposite to the vertical surface of shoulder 303A.

Figure 4A:
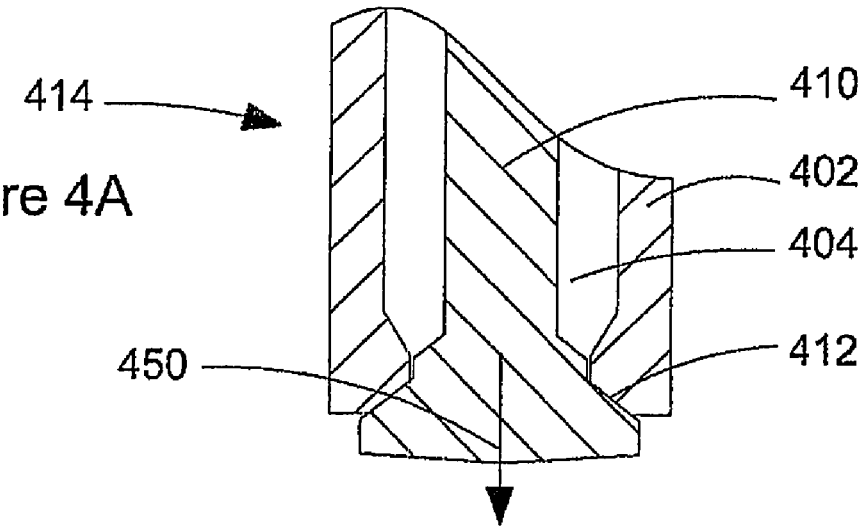
FIGS. 4A, 4B and 4C show schematic cross section views of an embodiment of a valve nozzle for an outward opening needle.
Figure 4B:
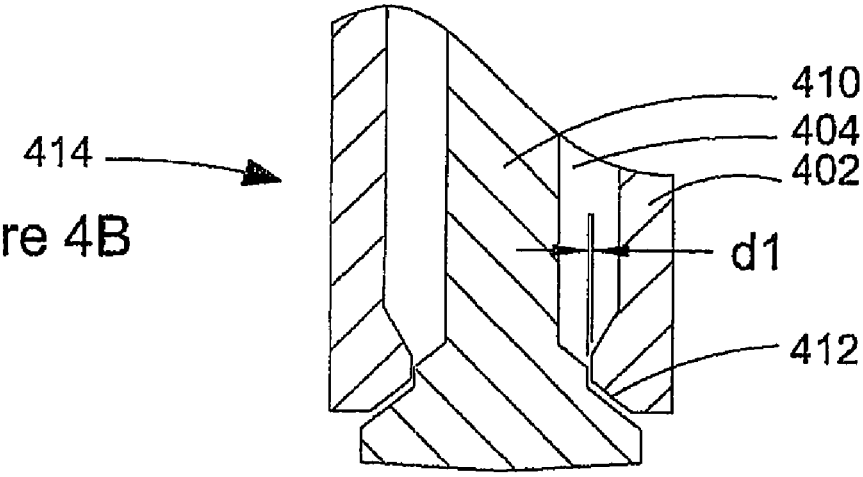
Figure 4C:
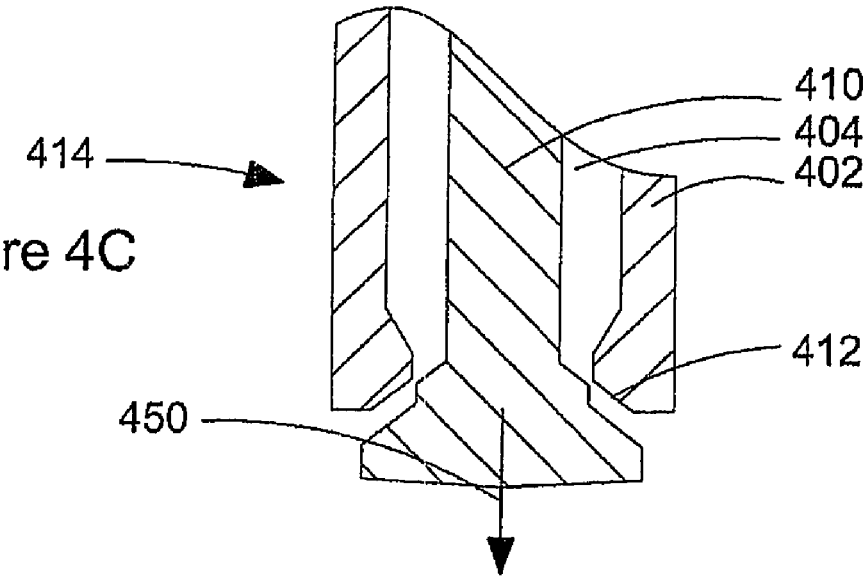

FIGS. 4A, 4B and 4C illustrate yet another embodiment of a valve body and valve needle arrangement that provides a substantially constant fuel mass flow rate for a predetermined range of valve needle movement. In FIG. 4A, valve needle 410 is shown in the closed position, seated against valve seat 412 so that fuel can not flow through nozzle 414. To begin a fuel injection event, valve needle 410 is movable in the direction of arrow 450. Valve needles such as the one shown in FIGS. 4A, 4B, 4C and 5, which are movable away from a valve seat and in a direction parallel to the direction of fuel flow are known as outward opening valve needles, and the fuel injection valves that employ outward opening valve needles are sometimes referred to as poppet valves. In FIG. 4B valve needle 410 has been lifted away from valve seat 412 to an open position within the range of valve needle movement where a substantially constant fuel mass flow rate can be injected. In FIG. 4B a portion of the vertical side surface of valve needle 410 provided by shoulder 403 is opposite to the vertical wall of valve body 402. The parallel and opposite vertical surfaces provide a gap therebetween, identified by d1. Like the other embodiments, this gap is sized to provide a flow area that restricts fuel flow through nozzle 414 to a substantially constant fuel mass flow rate for a range of valve needle movement as long as a portion of the vertical side surface of valve needle 410 is opposite to the vertical wall provided by valve body 402. In FIG. 4C valve needle 410 has been lifted beyond the point where the vertical surfaces of shoulder 403 and valve body 402 are opposite to each other. Beyond that point, the flow area between valve needle 410 and valve body 402 increases as valve needle 410 moves further away from valve seat 412. From the position in FIG. 4C, valve needle 410 can be lifted further in the direction of arrow 450 until it reaches a fully open position.

Figure 5:
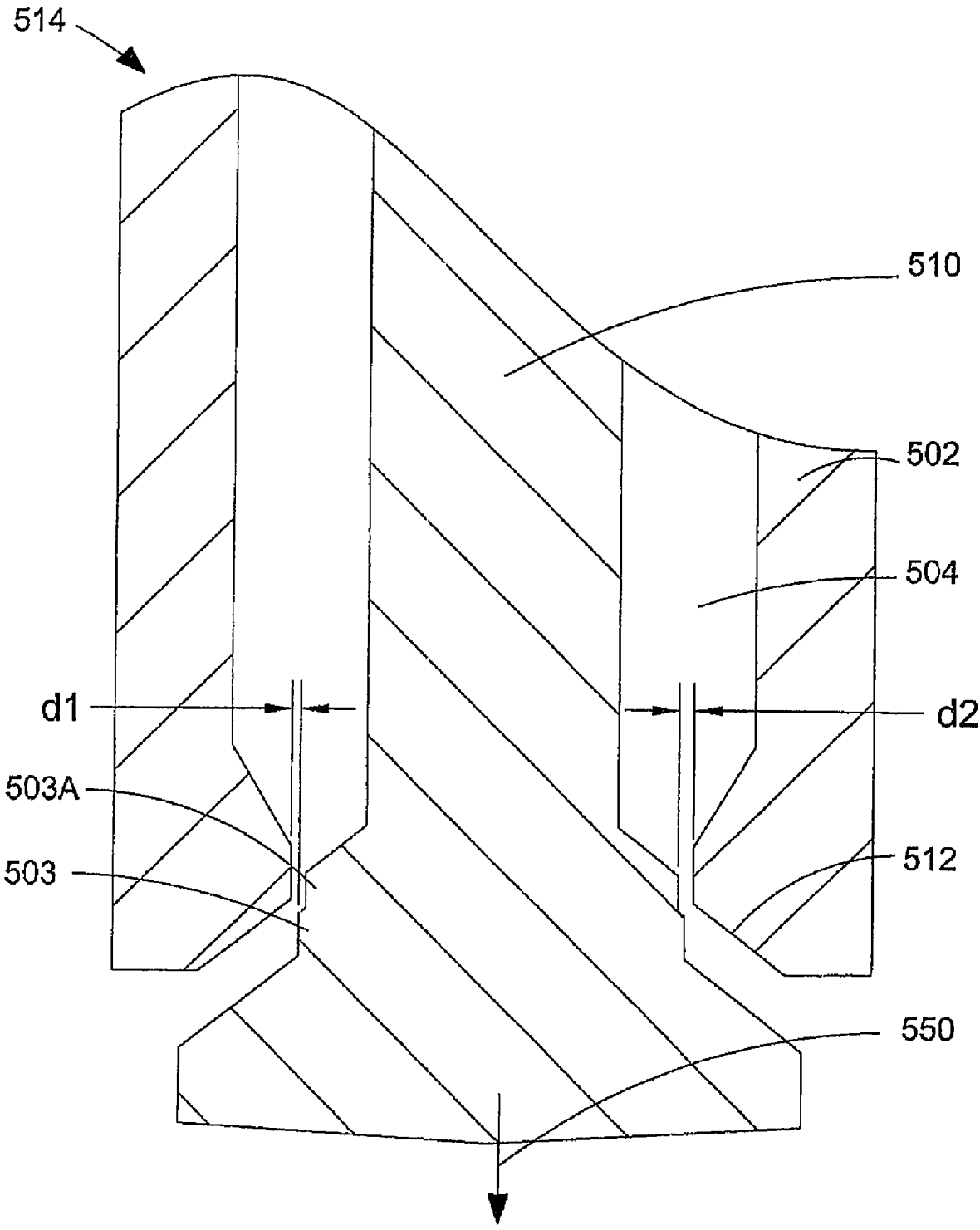
FIG. 5 is a schematic cross section view of an outward opening valve needle and a valve nozzle that cooperate with each other to provide two ranges of valve needle positions that each provide a substantially constant flow area whereby fuel mass flowrate is substantially constant when the valve needle is positioned anywhere within those ranges.

Another embodiment of a nozzle arrangement with an outward opening valve needle is shown in FIG. 5. Valve body 502 and valve needle 510 define the shown portion of fuel cavity 504. Valve needle 510 is in an open position, where it is has been lifted from the closed position in direction of arrow 550. The difference between this embodiment and the embodiment of FIGS. 4A, 4B and 4C is that valve needle 510 is provided with two shoulder areas 503 and 503A, which each provide a vertical surface parallel to the vertical surface of the opening through valve body 502. Shoulder 503 in FIG. 5 is similar to shoulder 403 in FIGS. 4A, 4B and 4C. Shoulder 503A provides a second parallel surface area that provides a larger constant flow area when the vertical surface of the opening through valve body 502 is opposite to it. Accordingly, the nozzle arrangement of FIG. 5 can provide two ranges of needle movement where the fuel mass flow rate can be substantially constant. A lower substantially constant fuel mass flow rate is provided when the vertical surface of shoulder 503 is opposite to the vertical surface of the opening through valve body 502 and a higher substantially constant fuel mass flow rate is provided when the vertical surface of shoulder 503A is opposite to the vertical surface of the opening through valve body 502. In the illustrated example, the difference in the constant flow areas for the two ranges of needle movement are defined at least in part by the differences in dimensions d1 and d2. Persons skilled in this technology will understand that other embodiments could achieve the same result without departing from the spirit and scope of the present disclosure. For example, the flow area can be increased without increasing the gap dimension by widening grooves, such as the ones shown in FIG. 2E to increase the constant flow area for the second range of valve needle movement.

Figure 6:
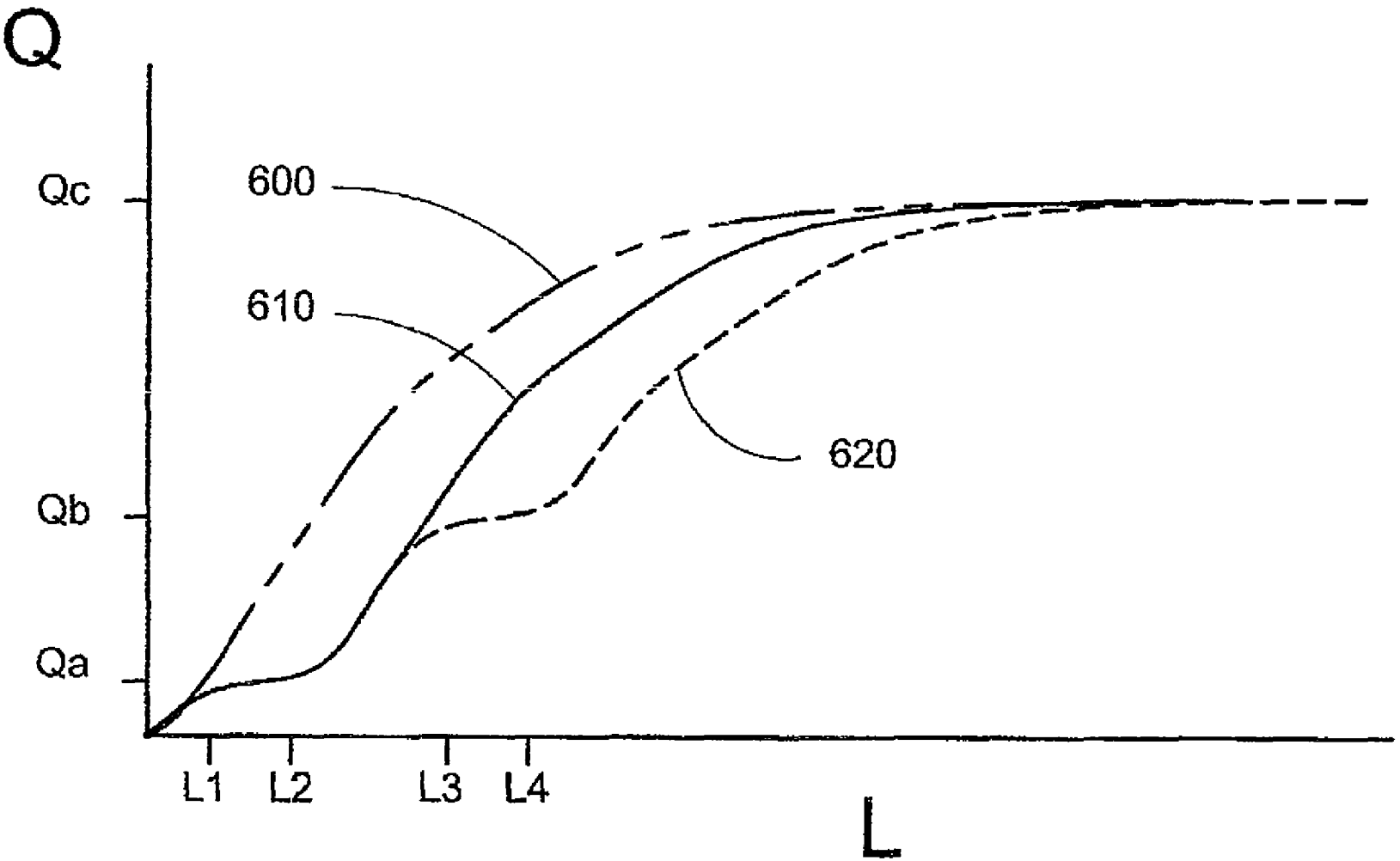
FIG. 6 is a plot of the mass flow rate through a fuel injection valve nozzle against valve needle lift. Two embodiments are illustrated, one with a single range of movement that causes a substantially constant mass flow rate and a second embodiment with two ranges of movement that cause respective substantially constant mass flow rates. These embodiments are compared to a plot of the flow characteristics for a conventional fuel injection valve.

FIG. 6 is a plot of fuel mass flow rate Q versus needle lift L. Line 600 shows a curve that is representative of conventional fuel injection valves. As depicted by line 600, with a conventional fuel injection valve, increases in needle lift cause progressive increases in fuel mass flow rate until maximum fuel mass flow rate Qc is reached, for example, when flow is choked by the restriction provided by the nozzle orifices or another restriction provided elsewhere in the fuel injection valve. The slope of line 600 flattens out as it approaches the choked flow rate so small variations in lift when the valve needle is commanded to near the fully open position do not have a significant impact on fuel mass flow rate.

For a fuel injection valve that controls needle lift to control fuel mass flow rate, with a conventional fuel injection valve, if Qa represents the desired fuel mass flow rate for idle or low load conditions, the needle is commanded to be lifted by distance L1 to deliver the desired flow rate. Because of the steep slope of line 600 near lift L1, even small deviations from position L1 can result in a significant variation in the actual fuel mass flow rate.

Solid line 610 shows a curve that is representative of a fuel injection valve that employs the features of the present disclosure. For example, at idle or low load conditions, the valve needle can be commanded to a position at the mid-point, between L1 and L2. Because the slope of line 610 between L1 and L2 is much flatter than the scope of line 600 for the same range of valve needle movement, the fuel injection valve of line 610 can be operated with improved consistency to improve engine performance, efficiency, and/or reduce emissions of unwanted combustion products like particulate matter and oxides of nitrogen or carbon, and/or reduce engine noise. The embodiments illustrated in FIGS. 2 and 4 show examples of fuel injection valves that can provide one range of valve needle movement where fuel can be injected with a substantially constant fuel mass flow rate. The range of movement between L1 and L2 represents the range of valve needle movement that corresponds to when the parallel vertical surfaces of the valve needle and the valve body cooperate with one another to define the gap dimensioned d1. When the valve needle moves further away from the valve seat and beyond this range, the fuel mass flow rate progressively increases along a steeper slope until the maximum fuel mass flow rate is reached.

Broken line 620 plots the flow characteristics for a fuel injection valve 1 such as the ones illustrated in FIGS. 3 and 5. These fuel injection valves provide two ranges of valve needle movement where the fuel mass flow rates are substantially constant. The range of movement between L3 and L4. represents the range of valve needle movement that corresponds to when the parallel vertical surfaces of the valve needle and the valve body cooperate with one another to define the gap dimensioned d2. When the valve needle is lifted to a position between L3 and L4, because the slope of line 620 is relatively flat, there is very little variation from commanded fuel mass flow rate Qb.

Figure 7:
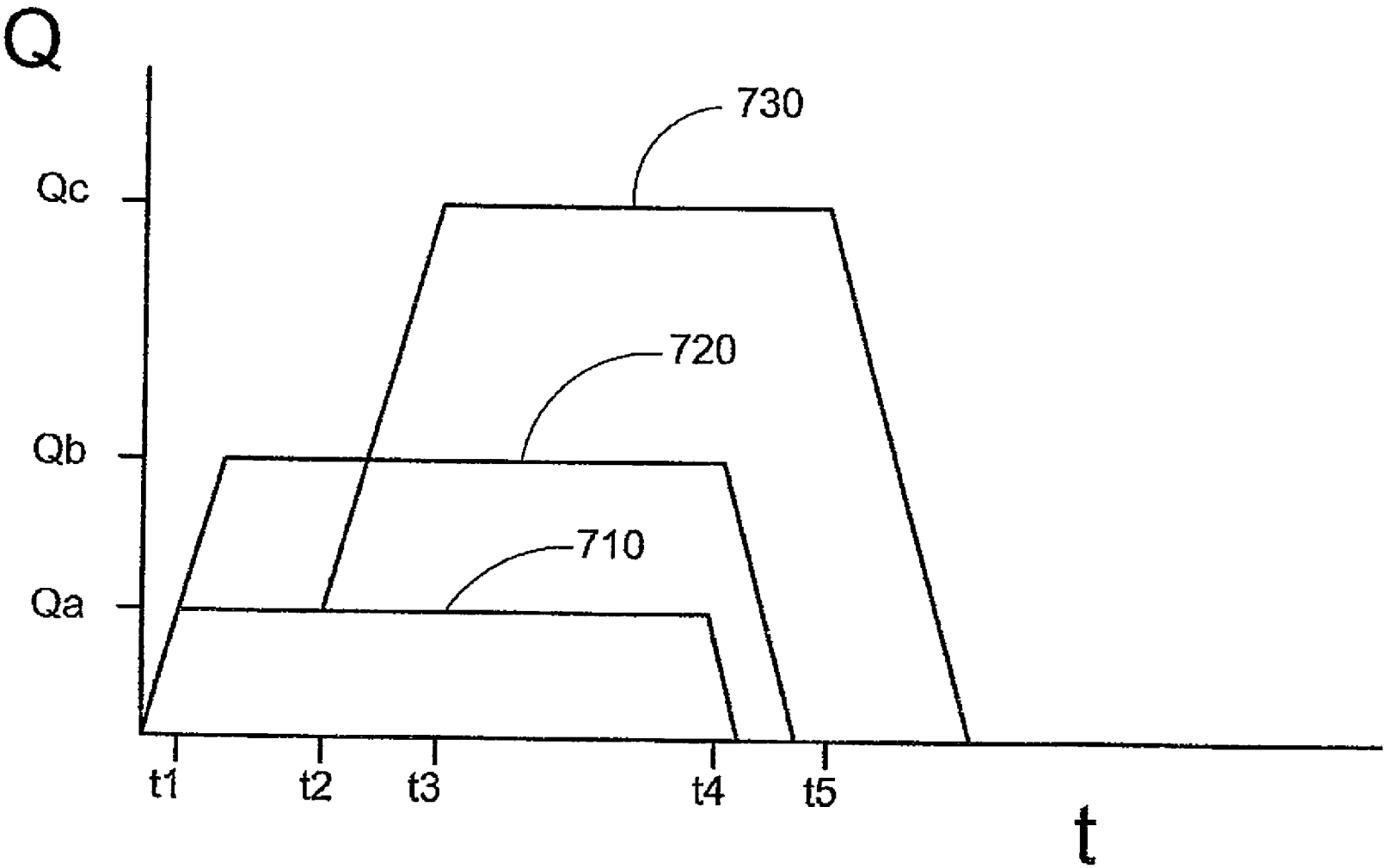
FIG. 7 is a plot of the commanded mass flow rate through a fuel injection valve. A number of commanded shapes are shown which can benefit from the consistency that can be achieved by employing the disclosed nozzle and valve needle features to improve the flow characteristics through fuel injection valves.

FIG. 7 is a plot of a number of examples of the commanded mass flow rate versus time through a fuel injection valve for a single fuel injection event. Each of the illustrated commanded shapes can benefit from the consistency that can be achieved by employing the disclosed nozzle and valve needle features to improve the flow characteristics through a fuel injection valve. In this plot, Qc again represents the maximum fuel mass flow rate. Line 710 corresponds to a relatively small fuel mass flow rate, Qa, such as what could be commanded for idle or low load conditions. The benefits have already been described of being able to reduce the variability in the quantity of fuel introduced into the engine from, cycle to cycle under idle and low load conditions. It can also be desirable to introduce the fuel directly into an engine combustion chamber in a stepped waveform, where initially a smaller fuel mass flow rate is injected, such as shown in FIG. 7 by Qa or Qb, followed by higher fuel mass flow rate such as shown by line 730. A fuel injection valve with two ranges of valve needle movement that provide substantially constant fuel mass flow rate can employ a controller that is programmed to use a waveform such as the one shown by line 710 for idle conditions and the waveform of line 720 for light load conditions or in a stepped waveform the beginning of line 710 until t2 and then the line of 720 after t2, or for higher load conditions after t2 line 730 can be selected. Persons skilled in this technology will understand that other combinations are possible such as the beginning of line 720 until t2 followed by line 730 to inject even more fuel into the engine. In some operating conditions it can also be beneficial to provide a downward step when the valve needle is moving from the open position to the closed position. The benefit of a fuel injection valve with the disclosed features is that the constant flow areas can be selected to provide more consistent fuel mass flow rates at predetermined steps in the waveforms employed to control needle movements, reducing cycle-to-cycle variability when the engine is operating.

The disclosed fuel injection valve was developed for gaseous fuels, but the same features can be beneficial for fuel injection valves that inject a liquid fuel. However, for a liquid fuel, there are additional considerations that must be taken into account such as cavitation and maintaining adequate pressure for atomization of the fuel. Cavitation can occur when a sudden pressure drop lowers the fuel pressure below the vaporization pressure and some of the fuel is vaporized before the fuel is discharged from the injection valve. Problems associated with cavitation and atomization can be avoided, for example, by employing one or more of the following strategies: (i) introducing the fuel to the fuel injection valve with an initial pressure that is high enough to ensure that fuel pressure remains above the vaporization pressure and adequately high after the restricted flow area to atomize the fuel when it exits the fuel injection valve; (ii) sizing the restricted flow area to limit the pressure drop so that fuel pressure is not reduced to less than the vaporization pressure or the minimum pressure required to atomize the fuel upon exiting the fuel injection valve; (iii) providing a smooth entrance into the restricted flow area to reduce turbulence that can cause low pressure regions; and (iv) manufacturing the nozzle and valve needle from materials that will not be damaged by exposure to the conditions associated with cavitation. With liquid fuels, it is possible to employ the disclosed features and realize many of the same benefits that can be achieved with gaseous fuels. For example, it is possible to achieve more stable performance and reduce engine noise under idle and low load conditions by reducing variability in the quantity of injected fuel.

While particular elements, embodiments and applications of the present invention have been shown and described, it will be understood that the invention is not limited thereto since modifications can be made by those skilled in the art without departing from the scope of the present disclosure, particularly in light of the foregoing teachings.

What is claimed is:

1. A method of regulating fuel mass flow rate into an engine through a nozzle of a fuel injection valve, said method comprising: actuating a valve needle to control valve needle lift, which is variable during an injection event and from one injection event to another injection event responsive to measured engine operating conditions, comprising engine load and speed; commanding a valve needle to move to a position between first and second intermediate positions, which are predetermined positions between a closed position and a fully open position when a predetermined constant fuel mass flow rate is desired, wherein said fuel injection valve is designed to allow a constant fuel mass flow rate when said valve needle is positioned between said first and second intermediate positions and the pressure of said fuel is constant; and commanding said valve needle to move to positions between said closed and fully open positions, but not between said first and second intermediate positions, when a fuel mass flow rate different from said predetermined constant fuel mass flow rate is desired.

2. The method of claim 1 further comprising commanding said valve needle to the mid-point between said first and second intermediate positions when said substantially constant mass flow rate is desired.

3. The method of claim 1 wherein said substantially constant fuel mass flow rate corresponds to the desired fuel mass flow rate for idle or low load conditions.

4. The method of claim 1 wherein said substantially constant fuel mass flow rate is regulated by providing a flow restriction within said nozzle with a constant flow area when said valve needle is positioned between said first and second intermediate positions.

5. The method of claim 1 wherein said second intermediate position corresponds to a larger valve needle lift than that of said first intermediate position and said fuel mass flow rate can be substantially and progressively increased by moving said valve needle from said second intermediate position toward said fully open position.

6. The method of claim 1 wherein said second intermediate position corresponds to a larger valve needle lift than that of said first intermediate position and said method further comprises commanding said valve needle to a position between said second intermediate position and a third intermediate position when a second substantially constant mass flow rate is desired, said fuel injection valve providing a first restricted flow area when said valve needle is positioned between said first and second intermediate positions and a second restricted flow area when said valve needle is positioned between said second and third intermediate positions, said second restricted flow area being larger than said first restricted flow area.

7. The method of claim 1 wherein said fuel mass flow rate can be substantially and progressively increased by moving said valve needle from said third intermediate position toward said folly open position.

8. The method of claim 1 further comprising injecting said fuel from said nozzle directly into a combustion chamber of said engine.

9. The method of claim 1 further comprising introducing said fuel into said nozzle in the gaseous phase.

10. The method of claim 9 wherein said fuel is selected from the group consisting of natural gas, methane, ethane, liquefied petroleum gas, lighter flammable hydrocarbon derivatives, hydrogen, and blends thereof.

11. The method of claim 1 further comprising directly actuating said valve needle with a strain-type actuator that comprises a transducer selected from the group consisting of piezoelectric, magnetostrictive, and electrostrictive transducers.

12. The method of claim 1 further comprising also controlling injection pulse width to assist with controlling the amount of fuel that is injected during an injection event, whereby pulse width is variable from one injection event to another injection event responsive to predetermined, measured engine operating conditions.

13. The method of claim 1 further comprising also controlling fuel injection pressure to assist with controlling the amount of fuel that is injected during an injection event, whereby fuel injection pressure is variable from one injection event to another responsive to predetermined measured engine operating conditions.

14. A method of regulating fuel mass flow rate into an engine through a nozzle of a fuel injection valve by controlling valve needle position, said method comprising: increasing fuel mass flow rate from zero to a first value by moving a valve needle from a closed position where it is urged against a valve seat to a first intermediate position; maintaining fuel mass flow rate substantially constant at about said first value when said valve needle is positioned between said first intermediate position and a second intermediate position, which is spaced from said first intermediate position; progressively increasing fuel mass flow rate beyond said first value by moving said valve needle from said second intermediate position towards a fully open position; increasing fuel mass flow rate to a maximum value by moving the valve needle to the fully open position; and actuating said valve needle to control valve needle lift responsive to measured engine operating conditions, comprising engine speed and load, wherein said valve needle position is variable during an injection event and from one injection event to another injection event.

15. The method of claim 14 comprising directly actuating said valve needle with a strain-type actuator.

16. The method of claim 14 wherein said first value is the fuel mass flow rate that is commanded when said engine is operating under idle or low load conditions.

17. The method of claim 14 further comprising commanding said valve needle to move according to a stepped waveform with a relatively low mass flow rate during a first step and a higher mass flow rate during a second step and wherein said first value is the fuel mass flow rate that is commanded for said first step.

* * * * *